US009845604B2

(12) United States Patent
Lockwood

(10) Patent No.: US 9,845,604 B2
(45) Date of Patent: Dec. 19, 2017

(54) DEVICE AND METHOD FOR ARRANGING AND SETTING TILES AND NON-VEGETATIVE GROUND COVERING ON A SUBSTRATE

(71) Applicant: Vera Lockwood, Bonney Lake, WA (US)

(72) Inventor: Vera Lockwood, Bonney Lake, WA (US)

( * ) Notice: Subject to any disclaimer, the term of this patent is extended or adjusted under 35 U.S.C. 154(b) by 0 days.

(21) Appl. No.: 14/883,926

(22) Filed: Oct. 15, 2015

(65) Prior Publication Data

US 2017/0183880 A1 Jun. 29, 2017

(51) Int. Cl.
*E01C 5/00* (2006.01)
*E04F 21/22* (2006.01)
*E01C 19/52* (2006.01)

(52) U.S. Cl.
CPC ..... *E04F 21/22* (2013.01); *E01C 19/526* (2013.01); *E01C 5/00* (2013.01)

(58) Field of Classification Search
CPC ..... E04F 21/20; E04F 21/22; E04F 21/1811; E04F 21/1838; E01C 19/52; E01C 19/526
USPC ..... 33/649, 646, 647; 52/749.11, 747.11
See application file for complete search history.

(56) References Cited

U.S. PATENT DOCUMENTS 1,380,485 A * 6/1921 Langeberg ..... E04O 15/025 33/649
2,426,825 A * 9/1947 Geary ..... E04G 3/26 182/147
2,814,533 A * 11/1957 Van Horn ..... E04G 3/26 182/129
3,245,192 A * 4/1966 Hilson ..... E04D 15/04 156/574
3,292,734 A * 12/1966 Swanberg ..... E04G 3/26 182/150
3,842,934 A * 10/1974 Bartlett ..... E04G 3/26 182/37
4,785,606 A * 11/1988 Burton ..... E04G 3/26 182/45
5,205,103 A * 4/1993 Burton ..... E04D 15/02 182/45
5,908,083 A * 6/1999 Hamilton ..... E04D 15/02 182/206
5,918,439 A * 7/1999 Metzer ..... E04D 1/26 33/649
6,189,227 B1 * 2/2001 Siegfried ..... E04D 1/26 33/613
6,796,049 B1 * 9/2004 Claxton ..... E04F 21/0092 33/527
2014/0196298 A1 * 7/2014 George ..... E04O 15/025 33/648

* cited by examiner

*Primary Examiner* — Paola Agudelo
(74) *Attorney, Agent, or Firm* — Mohr Intellectual Property Law Solutions, PC

(57) ABSTRACT

A tile and non-vegetative ground covering setting device including a housing, slidable rods with turning support means and stationing means are described herein. In some examples, the setting device includes a pair of housings and two pairs of slidable rods. In other examples, a slidable rod may be positioned perpendicularly to the other slidable rods. The device also comprises a platform, a handle, and an adequate number of securing means to maintain integrity of the device.

20 Claims, 6 Drawing Sheets

DEVICE AND METHOD FOR ARRANGING AND SETTING TILES AND NON-VEGETATIVE GROUND COVERING ON A SUBSTRATE

BACKGROUND

The present disclosure relates generally devices for setting and arranging tile and other non-vegetative floor or ground coverings on a substrate. In particular, a tile and non-vegetative ground covering setting and arranging device having turnable supports is described.

Known tile setting devices are not entirely satisfactory for the range of applications in which they are employed. When creating, for example, a pathway or floor, the tiles or stones are laid on a very carefully plotted substrate that is designed to hold several tiles or stones. The substrate typically includes an adhering agent such as sand or glue which has been carefully spread over the substrate to properly receive and retain the tiles or the stones. In many applications, tiles or stones are arranged by simply dropping them in place using a template or other type of guide. Thus, if a tile is accidently dropped or misplaced, removing it will cause damage to the substrate and the user will have to resurface or reapply the adhering agent before she can continue with the tile setting project. This results in added frustration and a waste of time and money for the user.

Using conventional devices for setting and arranging tiles, paving stones, or other types of non-vegetative floor or ground coverings, existing setting devices do not adequately provide a means to properly space the tiles to achieve symmetry. In addition, conventional tile setting devices do not adequately provide a way to arrange the tiles so as not to disturb the substrate, which can lead to imperfect and uneven arrangement, which results in increased time, cost, and effort to repair. Finally, conventional setting devices are not equipped to remove and re-set a tile or a stone without damaging the substrate in the event a mistake is made.

Thus, there exists a need for a setting device that improves upon and advances the design of known setting devices.

SUMMARY

The present disclosure is directed to a device for arranging tiles, paver stones, and other types of floor or ground coverings on a substrate. The device comprises a platform, at least one housing, a plurality of parallel slidable rods having turnable members, at least one perpendicular slidable rod having a stationing means, and an adequate number of securing means to maintain integrity of the device.

DETAILED DESCRIPTION

The disclosed tile setting device will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various tile setting devices are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-5, a first example of a device for setting and arranging tiles, paver stones, and other non-vegetative floor or ground coverings on a substrate is shown. Setting device 100 functions to enable a user to lift, transport, and arrange without disturbing the substrate, a piece of tile, a paver stone, or other similar non-vegetative floor or ground covering. Setting device 100, will now be described. The reader will appreciate from the figures and description below that setting device 100 addresses shortcomings of conventional tile and paver stone setting devices.

Figure 1:
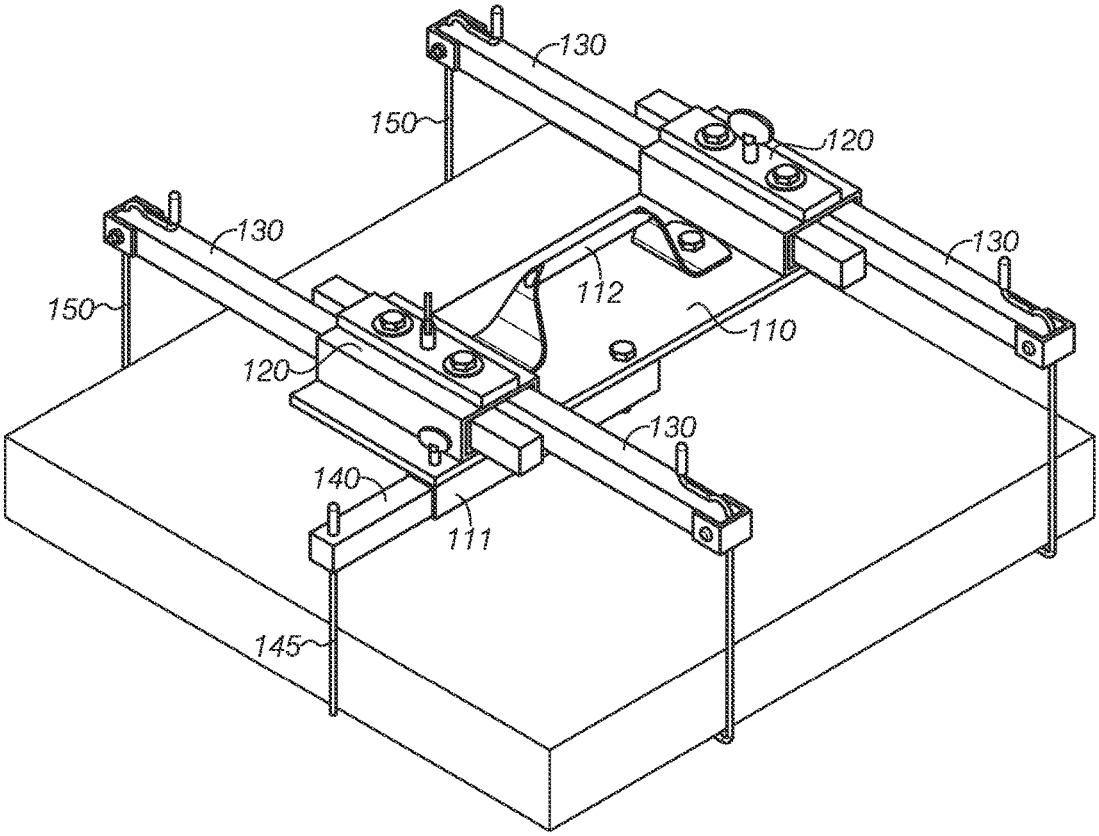
FIG. 1 is a perspective view of a first example of a tile setting device.

Setting device 100 includes a platform 110, at least one housing 120, at least one lower housing, 111, a plurality of parallel slidable rods 130, at least one perpendicular slidable rod 140, a plurality of turnable support means 150, and at least one stationing means 145. A setting device embodying the principles of the present invention can have any desired number of housing 120 and slidable rod 130. However, proper support of a tile of any shape requires a sufficient number to keep it from wobbling or slipping out of the device as it is transported. In accordance with the advantageousness of the invention, and as shown in the figures, setting device 100 illustratively has two housings 120, one lower housing 111, four parallel slidable rods 130, and one perpendicular slidable rod 140. It is an object of the present invention that platform 110 may support more than two housing(s) 120, more than one lower housing 111, more than four parallel slidable rod(s) 130, and more than one perpendicular slidable rod 140. Further, also shown in FIG. 1 is a square tile. It should be understood that tiles of differing shapes, such as for example, round, triangular, hexagonal, or other geometric shapes may be appropriate for use with setting device 100. It should be understood that the tile is included as an example only. It is an object of the present invention to accommodate tiles, stones, and non-vegetative ground or floor coverings of all shapes, sizes and weights that are appropriate for use within the system.

Figure 2:
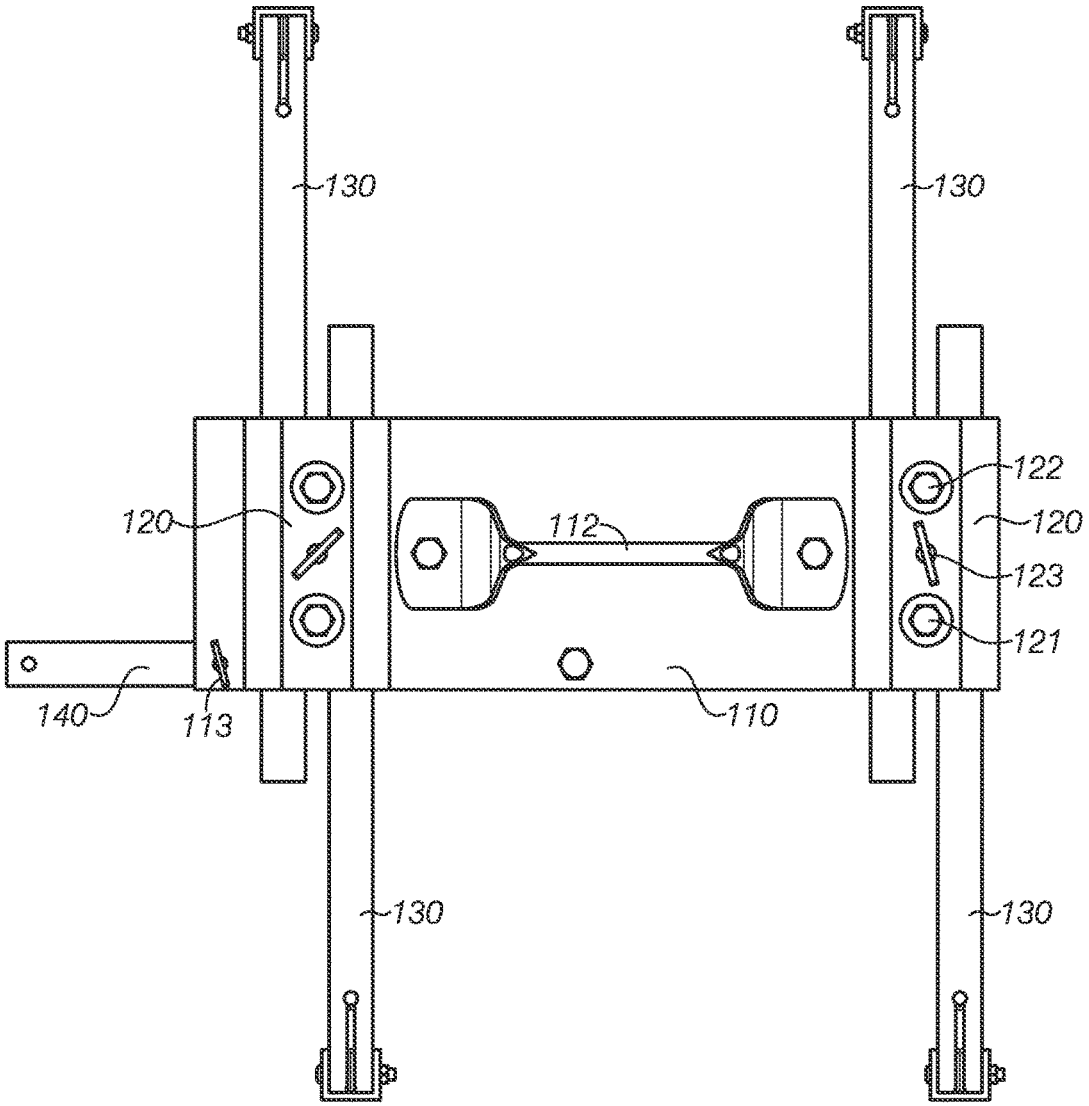
FIG. 2 is a plan view of the tile setting device shown in FIG. 1.

As can be seen in FIGS. 1 and 2, platform 110 functions to support housing 120 and lower housing 111. Housing 120 may be configured to enclose two parallel slidable rods 130 as shown. For illustrative purposes, and by way of example only, FIGS. 1 and 2 show two housing(s) 120, each encompassing two parallel slidable rods 130 for a total of four parallel slidable rods 130. In alternative embodiments (not shown), housing 120 may enclose more than two parallel slidable rods 130 and platform 110 may support more than two housing(s) 120, according to the user's needs. Housing 120 further comprises a first stationing means 121, a second stationing means 122, and a rod stay 123.

Also shown in FIGS. 1 and 2 is lower housing 111. It should be understood that it is an object of the present invention that platform 110 may support more than one lower housing 111 according to the user's needs. In the present embodiment, lower housing 111 encloses perpendicular slidable rod 140. Finally, platform 110 may also comprise a handle 112. In the present figure, handle 112 is shown to be in a substantially perpendicular position relative to housing 110, In this manner, handle 112 functions as a means of transport for setting device 100 and is intended to permit the user to carry setting device 100 with a single hand. In alternative embodiments (not shown), the grip portion of handle 112 may be elongated and positioned in a substantially parallel position relative to housing 110 such that the user may transport setting device 100 using two hands.

Figure 3:
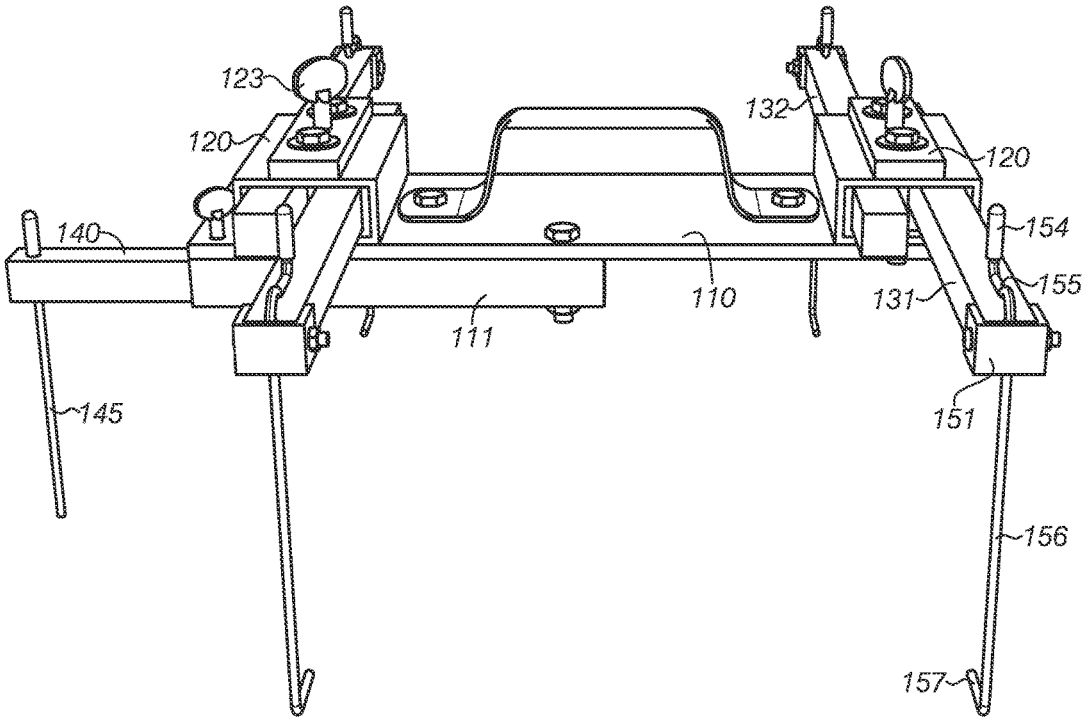
FIG. 3 is a side view of a tile setting device shown in FIG. 1.

Referring now to FIG. 3, a perspective side view of setting device 100 is shown. In the present figure, and for illustrative purposes only, housing 120 encloses a first parallel slidable rod 131 and a second parallel slidable rod 132. First parallel slidable rod 131 and second parallel slidable rod 132 may inserted into housing 120 such that they are substantially side by side. In this manner, first parallel slidable rod 131 may be pulled outward in one direction and second parallel slidable rod 132 may be pulled outward in the opposite direction. Thus, when using setting device 100, the user may slide first parallel slidable rod 131 outward in one direction to the desired length and tighten first stationing means 121 (shown in FIG. 2) to prevent forward or backward movement of first parallel slidable rod 131. The user then moves second parallel slidable rod 132 outward in the opposite direction to achieve the desired length and tightens second stationing means 122 (shown in FIG. 2) to prevent forward or backward movement of second parallel rod 132. In this manner, first parallel rod 131 and second parallel rod 132 are positioned to match the dimensions of a user's chosen piece of tile.

Once first parallel slidable rod 131 and second parallel slidable rod 132 are in the desired positions, the user tightens rod stay 123 (shown in FIG. 2) to prevent sideways movement of first parallel slidable rod 131 and second parallel slidable rod 132 as they are enclosed in housing 120. The user then repeats the above mentioned steps with each housing 120 located on platform 110. By way of example in the present figure, second parallel rod 132 is not extended outward completely and the distal end is adjacent to the approximate midpoint of first parallel rod 131 as shown. In alternative embodiments, the distal ends of first parallel rod 131 and second parallel rod 132 are completely enclosed in housing 120. Finally, the user may slide perpendicular slidable rod rod 140 outward to the desired length and a securing means 146 (identified by number in FIG. 6) to prevent forward or backward movement.

In the present embodiment, parallel slidable rod may be substantially block shaped and further comprise an aperture (not shown) located at the distal end of parallel slidable rod to receive parallel slidable rod 130. Parallel slidable rod further comprises a bracket 151 that is affixed to the distal end of parallel slidable rod 130 as shown. Bracket 151 is affixed lengthwise over distal end of parallel slidable rod 130 and functions to retain a turnable support means 150 as shown.

Turnable support means 150 further comprises a grip 154, a crank 155, a stem 156, and a foot 157. Foot 157 is of a sufficient length to extend substantially underneath a tile and act as a support for the tile. Grip 154 is configured to function as a means for the user to grasp turnable support means 150 and effectuate movement about the center axis within the aperture. Stem 156 is of a sufficient length to accommodate the height of a particular tile. It should be understood that the dimensions of stem 156 and foot 157 are customizable and may change depending on the dimensions of the tile the user wishes to arrange. In this manner, a user may set and arrange different shapes and sizes of tiles or stones in a single project.

Once parallel slidable rod(s) 130 are in the appropriate position, the user, via grip 154, turns turnable support means 150 such that crank 155 effectuates reciprocal circular movement about stem 156 and foot 157 is rotated until it is facing substantially inward as shown. The user then places a tile such that it rests on foot 157 (shown in FIG. 1).

Figure 4:
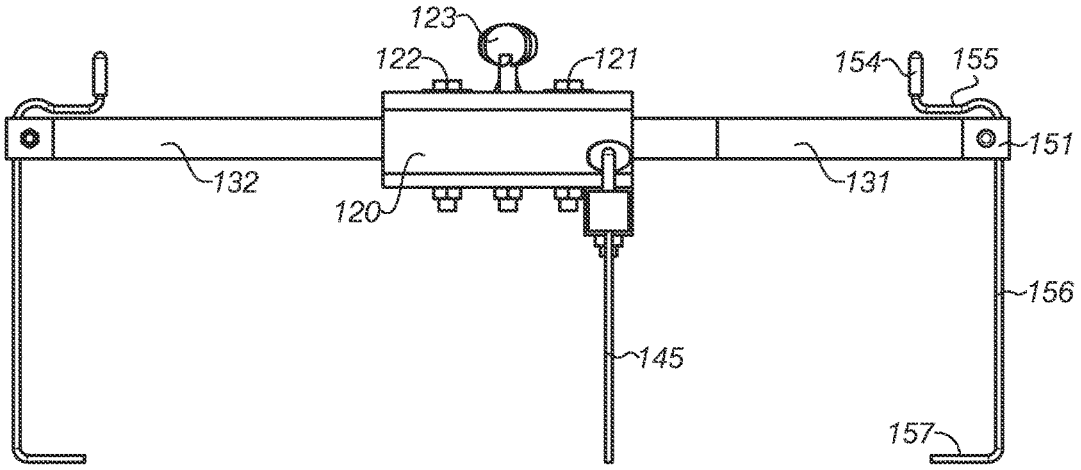
FIG. 4 is a lengthwise perspective view of a tile setting device shown in FIG. 1.

Referring now to FIG. 4, an alternate view of setting device 100 is shown. As mentioned above, platform 110 further comprises lower housing 111 which encloses perpendicular stationing means 145. Perpendicular slidable rod 140 further comprises an opening 141 thought which perpendicular stationing means 145 may be inserted. Perpendicular stationing means 145 further comprises knob 146 (shown in further detail in FIG. 6) that functions to permit the user to grasp perpendicular stationing means 145 and effectuate vertical movement. Further, stationing means 145 has a circumference that is greater than the circumference opening 141. In this manner, knob prevents perpendicular stationing means 145 from slipping through opening 141.

Similarly, after the user has positioned perpendicular slidable rod 140 to the appropriate width of a piece of tile, the user may then grasp knob 146 and raise stationing means 145 through opening 141. Then, after the user has positioned turnable support means 150 to position foot 157 underneath the tile, stationing means 145 is lowered to rest on an outer edge of the tile to provide further support as the tile is transported.

When a user wishes to position the tile, setting device 100 is placed over the desired location and gently rested on the substrate. Using stationing means 145 as a lengthwise guide and turnable support means 150 as a horizontal guide, the user is able to position the tile appropriately in relation to an adjacent surface such as a wall or another tile. When the tile is appropriately positioned, the user grasps grip 154 and turns turnable support means 150 such that the foot 157 turns outward and emerges from underneath the tile. The user repeats this turning for each turnable support means 150 and, via gravity, the tile or stone gently falls into place and the substrate remains intact. To release tile setter, the user grips knob 146 and pulls stationing means 145 upward.

In the event that the location of a tile that has already been placed is needed to be changed, the user extends parallel slidable rod 130 out as far as it will go and via grip 154, raises turnable support means 150 until foot 157 is resting against the underside of platform 110. The user then turns turnable support means 150 outward so that foot 157 is facing outward from the edge of the tile. The user then positions setting device 100 over the tile and gently lowers setting device 100 such that turnable support members are moved upward by the substrate and the platform is lowered. The user then turns turnable support means 150 inward and such that foot 157 is gently moved underneath the bottom surface of the tile. The tile is then lifted, repositioned, and re-set in the manner described above. In this manner, a tile or stone may be repositioned with minimal damage to the substrate.

Figure 5:
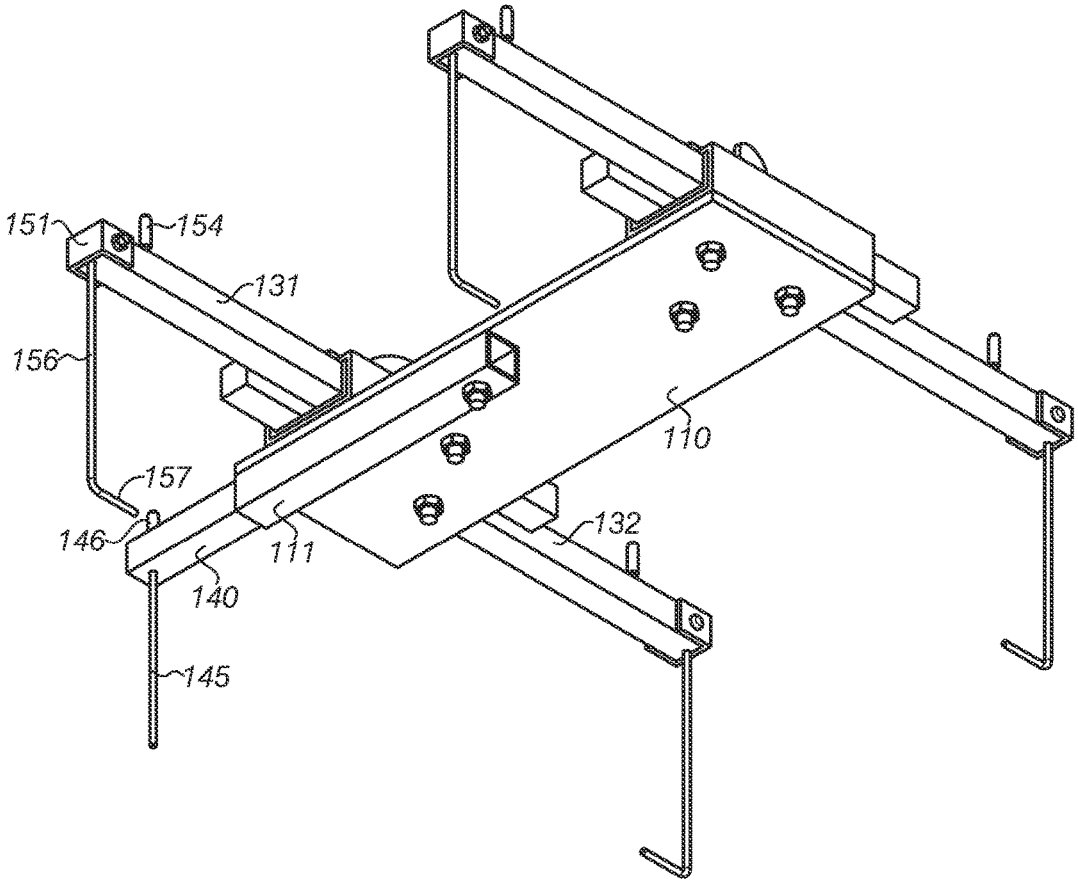
FIG. 5 is a perspective view of the underside of a tile setting device shown in FIG. 1.
Figure 6:
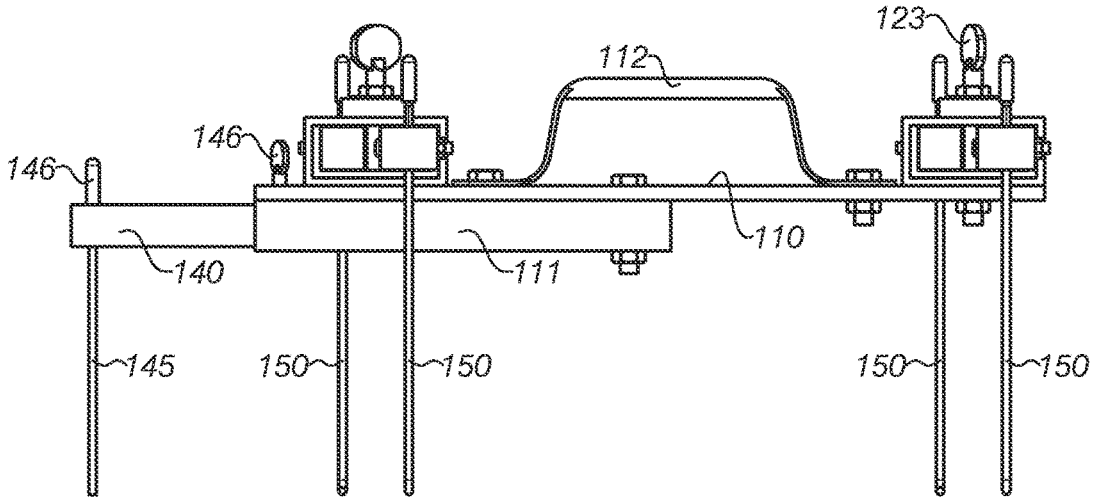
FIG. 6 is a perspective view of the side of a tile setting device shown in FIG. 1.

By way of example, FIG. 5 shows a perspective view of the underside of setting device 100, where lower housing 111 encloses one perpendicular slidable rod 140 and one stationing means 145 can be seen. Also shown in FIG. 5 are two housing(s) 120 and four parallel slidable rods 130 that are positioned such that the distal end of first parallel slidable rod 131 is adjacent to approximately middle position of second parallel slidable rod 132. Finally, FIG. 6 shows a side view of setting device whereby perpendicular slidable rod 140 is partially extended and stationing means 145 and turnable support means 150 are completely extended downward.

It should be understood that the present disclosure uses the term 'tile' to broadly encompass any type of floor or non-vegetative ground covering that is intended to be arranged on a substrate, including, but not limited to, ceramic and travertine tiles, flagstones, paver stones, marble, slate, wood and faux wood, granite, concrete, and any other similar material that is used for such purposes. It should further be understood that the present invention may be made of any sturdy material suitable for its stated purposes including, but not limited to, metal and metal alloys, wood, plastics, and other synthetic materials, now known or later discovered.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A device comprising:

a platform;

a first housing located on a top surface or a bottom surface of the platform, wherein the first housing is shaped to receive a portion of a first rod;

the first rod affixed in the first housing, wherein the first rod is adjustable to extend from the first housing along a first plane that is parallel to the top surface or the bottom surface of the platform;

a first support member connected to a distal end of the first rod, wherein the first support member extends in a direction perpendicular to the top surface or the bottom surface of the platform;

a second housing located on the top surface or the bottom surface of the platform, wherein the second housing is shaped to receive a portion of a second rod;

the second rod affixed in the second housing, wherein the second rod is adjustable to extend from the second housing along the first plane that is parallel to the top surface or the bottom surface of the platform; and a second support member connected to a distal end of the second rod, wherein the second support member extends in a direction perpendicular to the top or bottom surface of the platform.

2. The device of claim 1, wherein the first housing is located on the top surface of the platform and the second housing is located on the bottom surface of the platform.

3. The device of claim 1, wherein the first housing further comprises a stationing means to prevent movement of the first rod.

4. The device of claim 1, further comprising:

a third rod, wherein the first housing is shaped to receive a portion of the third rod, wherein the third rod is adjustable to extend from the first housing along the first plane that is parallel to the top surface or the bottom surface of the platform; and a third support member connected to a distal end of the third rod, wherein the third support member extends in a direction perpendicular to the top surface or the bottom surface of the platform.

5. The device of claim 4, wherein the first rod is extended outward in a first direction and the third rod is extended outward in a second direction.

6. The device of claim 1 wherein the first housing further comprises a securing means to prevent sideways movement of the first rod.

7. The device of claim 1 wherein the second housing further comprises a stationing means to prevent movement of a second rod.

8. The device of claim 1 wherein the first support member is a turnable support member.

9. The device of claim 8, wherein the turnable support member comprises at least one of a grip, a crank, a stem, or a foot.

10. The device of claim 9, wherein a length of the stem is a defined length to accommodate a threshold height of a tile.

11. The device of claim 9, wherein the grip is configured to rotate the foot of the turnable support member via the crank to a first position and a second position.

12. The device of claim 9 wherein the turnable support member further comprises a height adjustment member configured to raise or lower the turnable support member relative to the top surface or the bottom surface of the platform.

13. The device of claim 9, wherein the foot is shape to support a tile.

14. The device of claim 1, further comprising:

a third housing located on the top surface or the bottom surface of the platform, wherein the third housing is shaped to receive a portion of a third rod;

the third rod, wherein the third rod is adjustable to extend from the third housing along a second plane that is parallel to the top surface or the bottom surface; and a third support member connected to a distal end of the third rod, wherein the third support member extends in a direction perpendicular to the top or bottom surface.

15. An apparatus comprising:

a platform;

a first housing connected to the platform, wherein the first housing is shaped to receive a portion of a first rod;

the first rod affixed to the first housing, wherein the first rod is adjustable to extend from the first housing;

a first support member connected to a distal end of the first rod;

a second housing connected to the platform, wherein the second housing is shaped to receive a portion of a second rod;

the second rod affixed to the second housing, wherein the second rod is adjustable to extend from the second housing;

a second support member connected to a distal end of the second rod;

a third housing connected to the platform, wherein the third housing is shaped to receive a portion of a third rod;

the third rod affixed to the third housing, wherein the second rod is adjustable to extend from the third housing; and a third support member connected to a distal end of the third rod.

16. The apparatus of claim 15, wherein the first support member and the second support member are adjustable to switch between a first position and a second position.

17. The apparatus of claim 16, wherein the first support member and the second support member are configured to support a tile in the first position.

18. An apparatus comprising:

a platform;

a first housing connected to the platform, wherein the first housing is shaped to receive a first rod and a second rod;

the first rod affixed to the first housing, wherein the first rod is adjustable to extend from the first housing;

a first support member connected to a distal end of the first rod;

the second rod affixed to the first housing, wherein the second rod is adjustable to extend from the first housing;

a second support member connected to a distal end of the second rod;

a second housing connected to the platform, wherein the second housing is shaped to receive a third rod and a fourth rod;

the third rod affixed to the second housing, wherein the third rod is adjustable to extend from the second housing;

a third support member connected to a distal end of the third rod;

the fourth rod affixed to the second housing, wherein the fourth rod is adjustable to extend from the second housing; and a fourth support member connected to a distal end of the fourth rod.

19. The apparatus of claim 18, further comprising:

a third housing connected to the platform, wherein the third housing is shaped to receive a portion of a fifth rod;

the fifth rod affixed to the third housing, wherein the fifth rod is adjustable to extend from the third housing; and a fifth support member connected to a distal end of the fifth rod.

20. The apparatus of claim 18, further comprising a tile supported by at least one of the first support member, the second support member, the third support member, or the fourth support member.

* * * * *